US007465261B2

(12) United States Patent
Barnard et al.

(10) Patent No.: US 7,465,261 B2
(45) **Date of Patent: *Dec. 16, 2008**

(54) CARRIAGE FOR A COLLAPSIBLE REFORMER EXERCISE APPARATUS

(75) Inventors: Edward D. Barnard, Roseville, CA (US); Ken Endelman, Sacramento, CA (US)

(73) Assignee: Balanced Body, Inc., Sacramento, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/936,023

(22) Filed: Nov. 6, 2007

(65) Prior Publication Data

US 2008/0058174 A1 Mar. 6, 2008

Related U.S. Application Data

(63) Continuation of application No. 11/070,362, filed on Mar. 1, 2005, now Pat. No. 7,294,098.

(51) Int. Cl.
*A63B 26/00* (2006.01)

(52) U.S. Cl. ..... 482/142; 482/121

(58) Field of Classification Search ..... 482/121, 482/142

See application file for complete search history.

(56) References Cited

U.S. PATENT DOCUMENTS

| | | | |
|---|---|---|---|
| 339,638 | A | 4/1886 | Goldie |
| 1,621,477 | A | 3/1927 | Pilates |
| 1,738,987 | A | 12/1929 | Dattilo |
| 1,750,549 | A | 3/1930 | Thompson et al. |
| 1,979,783 | A | 11/1934 | Williams et al. |
| 1,980,036 | A | 11/1934 | Casler et al. |
| 2,733,922 | A | 2/1956 | Diego |
| 3,261,606 | A | 7/1966 | Elia et al. |
| 3,586,322 | A | 6/1971 | Kverneland |
| 3,770,267 | A | 11/1973 | McCarthy |
| 3,892,404 | A | 7/1975 | Martucci |

(Continued)

FOREIGN PATENT DOCUMENTS

| | | |
|---|---|---|
| DE | 2944599 | 5/1981 |

(Continued)

OTHER PUBLICATIONS

Stott Pilates Reformers, http://www.stottpilates.com/equipment/ref_choice.html.

(Continued)

*Primary Examiner*—Lori Amerson
(74) *Attorney, Agent, or Firm*—Greenberg Traurig, LLP

(57) ABSTRACT

A carriage for use in a reformer exercise apparatus is disclosed that has a pair of upwardly extending folding shoulder stops mounted thereto at one end and a headrest between the shoulder stops that extends outward from the carriage toward the head end of the frame. A pair of roller wheels at the head end and a pair at the foot end of the carriage support the platform. A single common axle supports the head end pair of rollers from the carriage, forms a pivot support for the folding shoulder stops, and forms part of an adjustable position support assembly for the headrest. The shoulder stops are preferably attached to a tubular sleeve that rotates on the common axle.

10 Claims, 7 Drawing Sheets

U.S. PATENT DOCUMENTS

| | | | |
|---|---|---|---|
| 4,084,815 | A | 4/1978 | Flannery |
| 4,272,074 | A | 6/1981 | Sferele |
| 4,290,600 | A | 9/1981 | Kolbel |
| 4,357,010 | A | 11/1982 | Telle |
| 4,376,533 | A | 3/1983 | Kolbel |
| 4,383,684 | A | 5/1983 | Schliep |
| 4,517,966 | A | 5/1985 | von Othegraven |
| 4,700,945 | A | 10/1987 | Rader |
| 4,706,953 | A | 11/1987 | Graham |
| 4,709,918 | A | 12/1987 | Grinblat |
| 4,768,776 | A | 9/1988 | Giannotti |
| 4,775,150 | A | 10/1988 | Graham |
| 4,776,583 | A | 10/1988 | Jennings |
| 4,884,802 | A | 12/1989 | Graham |
| 4,911,438 | A | 3/1990 | Van Straaten |
| 4,974,832 | A | 12/1990 | Dalebout |
| 5,014,966 | A | 5/1991 | Wang |
| 5,024,214 | A | 6/1991 | Hayes |
| 5,066,005 | A | 11/1991 | Luecke |
| 5,207,628 | A | 5/1993 | Graham |
| 5,263,913 | A | 11/1993 | Boren |
| 5,338,278 | A | 8/1994 | Endelman |
| 5,352,169 | A | 10/1994 | Eschenbach |
| 5,364,327 | A | 11/1994 | Graham |
| D354,780 | S | 1/1995 | Endelman |
| D354,781 | S | 1/1995 | Endelman |
| 5,423,729 | A | 6/1995 | Eschenbach |
| D362,700 | S | 9/1995 | Breibart et al. |
| 5,529,554 | A | 6/1996 | Eschenbach |
| 5,580,340 | A | 12/1996 | Yu |
| 5,607,381 | A | 3/1997 | Endelman |
| 5,653,670 | A | 8/1997 | Endelman |
| 5,681,249 | A | 10/1997 | Endelman |
| 5,792,033 | A | 8/1998 | Merrithew |
| 5,795,271 | A | 8/1998 | Pearson |
| 5,807,217 | A | 9/1998 | Endelman |
| 5,816,981 | A | 10/1998 | Hung |
| 5,853,357 | A | 12/1998 | Jones, Jr. |
| 6,179,759 | B1 | 1/2001 | Tellone |
| 6,186,929 | B1 | 2/2001 | Endelman et al. |
| 6,206,530 | B1 | 3/2001 | Eberts |
| 6,371,895 | B1 | 4/2002 | Endelman et al. |
| 6,527,685 | B2 | 3/2003 | Endelman et al. |
| 6,971,976 | B2 | 12/2005 | Endelman et al. |

FOREIGN PATENT DOCUMENTS

| | | |
|---|---|---|
| FR | 1470421 | 1/1967 |
| FR | 2481125 | 4/1980 |
| FR | 2625907 | 7/1989 |
| WO | WO 86/01735 | 3/1986 |

OTHER PUBLICATIONS

Stott Pilates SPX At Home Reformer, http://www.stottpilates.com/equipment/ref_AtHomeSPX.html.

CARRIAGE FOR A COLLAPSIBLE REFORMER EXERCISE APPARATUS

CROSS REFERENCE TO RELATED APPLICATIONS

This application is a continuation of U.S. patent application Ser. No. 11/070,362, filed Mar. 1, 2005. This application is related to U.S. patent application Ser. No. 10/035,842 filed Dec. 24, 2001, published as Publication No. US-2002-0058573-A1, which is hereby incorporated by reference in its entirety.

BACKGROUND OF THE INVENTION

1. Field of the Invention

This invention relates generally to the field of exercise equipment in which a movable carriage is utilized to at least partially support a user's body, commonly referred to as a "reformer", and more particularly to a telescopically collapsible reformer with a compact movable carriage.

2. Description of the Related Art

Joseph H. Pilates, in U.S. Pat. No. 1,621,477, originally developed the concept of using a wheeled platform carriage connected to a resistance device such as a set of weights in conjunction with a stationary frame to provide a variable resistance against which a user could push with his/her feet or pull with the arms while in a sitting or recumbent position in order to exercise the major muscle groups of the user's trunk, legs and/or arms. Since that time many changes and improvements in the design of such an apparatus have occurred.

U.S. Pat. Nos. 5,338,276, 5,607,381 and 5,681,249 disclose reformers and several footrest arrangements and adjustable headrest assemblies for this type of exercise apparatus. One of the difficulties, which the currently available reformers do not optimally address, is the portability and storability of the apparatus. My related patent application identified above discloses a collapsible reformer apparatus that is easily stored and transported. However, this reformer has a carriage that is complex to manufacture. Accordingly, there is a need for a simpler carriage for a collapsible reformer type of exercise apparatus.

SUMMARY OF THE INVENTION

The reformer exercise apparatus in accordance with embodiments of the present invention addresses the above-identified limitations in conventional reformer designs. An embodiment of the present invention is an exercise apparatus that has a wheeled carriage having a rigid platform with a generally flat top surface. The carriage is movably mounted on parallel track members of a generally rectangular telescopically collapsible frame, which has a head end and a foot end. The carriage has a pair of upwardly extending folding shoulder stops mounted thereto at one end and a headrest between the shoulder stops that extends outward from the carriage toward the head end of the frame. A single common axle carried by the carriage frame supports and provides a pivot for the folding shoulder stops. A pair of roller wheels at the head end and a pair at of roller wheels at the foot end of the carriage are positioned to roll on the track members. Preferably the single common axle also supports the head end pair of roller wheels and forms part of an adjustable position support for the headrest. A plurality of elastic members such as coil springs may be selectively connected between the foot end and the carriage to elastically bias the carriage toward the foot end of the frame.

The carriage assembly has a generally rectangular frame. The carriage frame has a pair of spaced parallel channels that support roller wheels at each end thereof that ride on the reformer frame rails. A single axle rod extends across the carriage frame between the head end channels and provides a pivot support for a pair of shoulder stop fastened to the axle. Preferably the shoulder stops are fastened to a support tube or sleeve that rides on the axle rod and the axle rod ends pass through the head ends of the channels. The axle rod may also preferably pass through the head end rollers, and provide part of a support for the headrest.

The assembly preferably includes a pair of spaced shoulder stops foldably attached to the axle via the support tube at a head end of the carriage frame and an adjustable headrest attached to the frame and positioned between the pair of folding shoulder stops. The folding shoulder stops are fastened to the tube such that the shoulder stops can rotate with the tube about the axle rod between an upright position and a folded position. The headrest has a bracket pivotally attached to an underside of the headrest that engages the shoulder stop support tube. The bracket has a series of notches to selectively receive the support tube to position the headrest at a desired position. The single axle rod in one embodiment thus serves four functions: it supports the head end support rollers, supports the carriage frame, supports the shoulder stops, and supports the headrest.

For storage, the frame rail assemblies may be telescopically collapsed, capturing the carriage between the head and foot ends, and the shoulder stops can be unlatched and folded back over the axle rod so that the tops of the shoulder stops fit into cutouts in the head end of the reformer frame to make a compact package that may be rolled under a bed, stored in a closet, or transported in a vehicle.

Other objects, features and advantages of the present invention will become apparent from a reading of the following detailed description when taken in conjunction with the accompanying drawing wherein a particular embodiment of the invention is disclosed as an illustrative example.

DETAILED DESCRIPTION OF THE INVENTION

Figure 5:
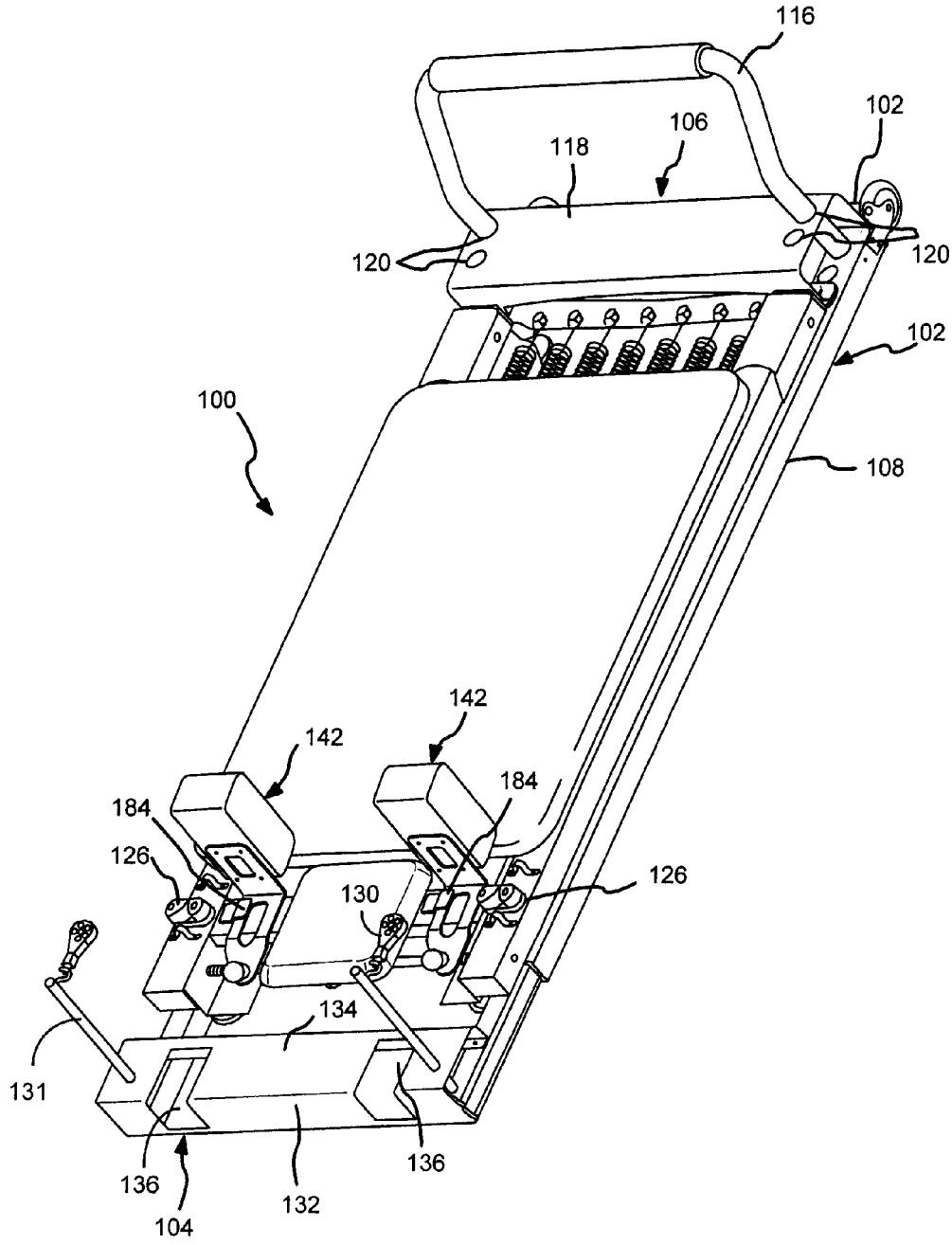
FIG. 5 is a perspective view of a collapsible reformer with the carriage of FIG. 1 and the telescopic frame partially collapsed and the shoulder stops in an upright position.
Figure 6:
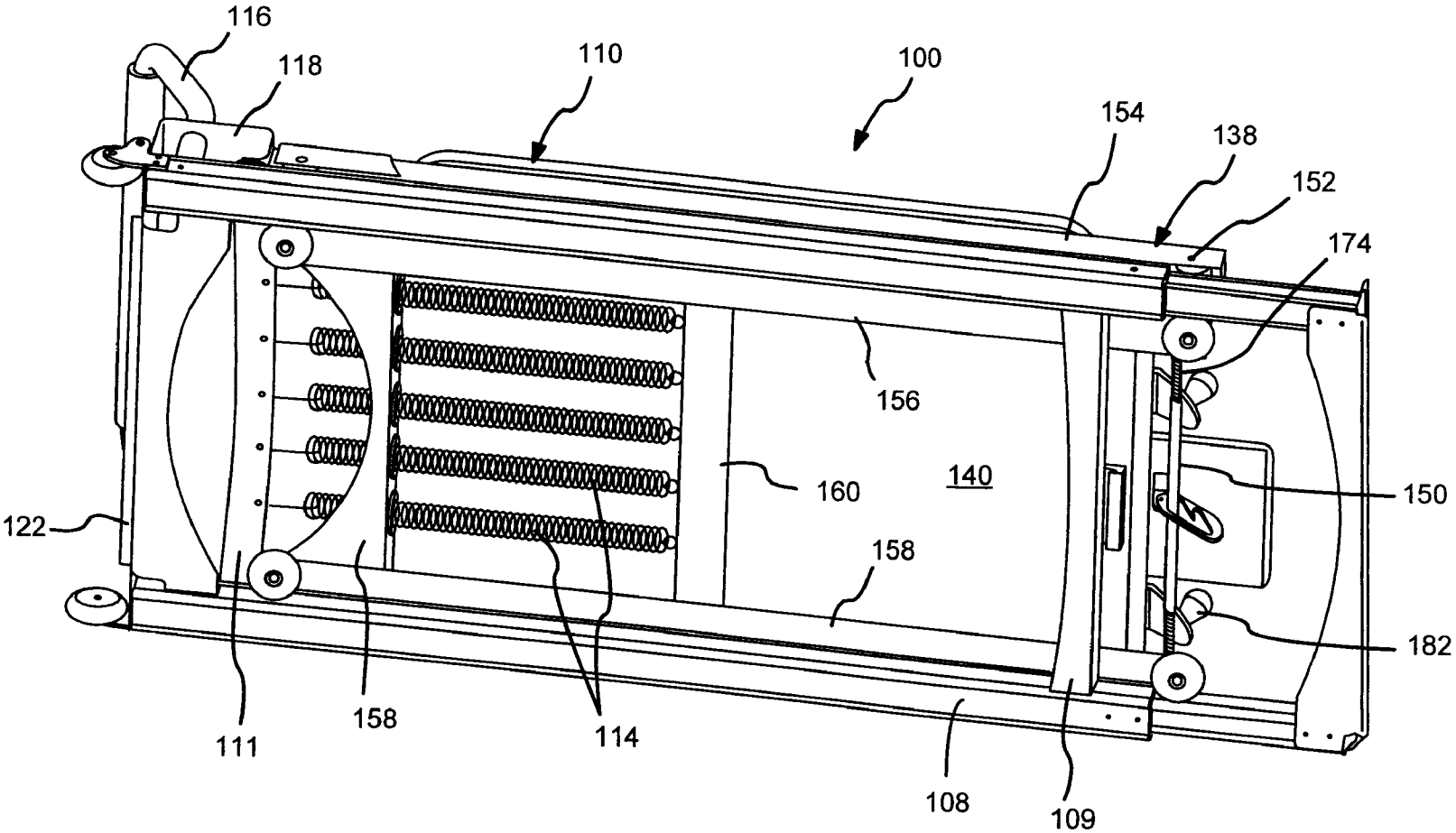
FIG. 6 is a perspective view of the underside of the reformer shown in FIG. 5.

A reformer exercise apparatus 100 in accordance with an embodiment of the present invention is shown in upper and lower perspective views in FIGS. 5 and 6 respectively. In these two views, the telescopic frame 102 of the reformer 100 is shown collapsed rather than fully extended. The frame 102 has a head end 104 and a foot end 106 and a pair of parallel track or rail member assemblies 108 separating the head end 104 from the foot end 106.

A movable carriage assembly 110 in accordance with an embodiment of the present invention is shown in partial perspective views in FIGS. 1 through 4. The carriage assembly 110 includes four roller wheels 112 (shown in FIGS. 3 and 7) fastened to the underside of the carriage 110. The roller wheels 112 roll on the track member assemblies 108 to support and guide movement of the carriage 110 back and forth along the track member assemblies 108 of the frame 102. Up to seven elastic members, e.g., springs 114, shown in FIGS. 5, 6, and 7, may be selectively connected between the carriage 110 and the foot end 106 to bias the carriage 110 toward the foot end 106 with varying amounts of spring force.

A foot bar 116 is removably fastened to the frame 102 at the foot end 106 so as to provide a stationary support for a user to push against in order to move the carriage 110 back and forth along the track member assemblies 108. The foot bar 116 may be withdrawn, reversed, i.e., turned around, and reinserted into one of two sets of apertures 120 in the foot end 106 to provide a different horizontal foot position. This moves the foot bar 116 closer to or away from the carriage assembly 110. Thus, there are potentially four positions in which the user can place the foot bar 116 accommodating those users that may have shorter or longer legs.

The foot end 106 also includes a horizontal foot platform 118 for a standing user to place one foot on while the other foot is placed on the carriage assembly 110 for standing exercises on the apparatus 100. This platform 118 is preferably made of two pieces of folded sheet material such as aluminum, aluminum alloy or rigid plastic, and more preferably of steel sheet metal, and also serves as a cross member to support and space the rail member assemblies 108 apart. The second piece of sheet metal forms a channel shaped trough that forms jump board support 122. The jump board support 122, and the upper portion of the foot bar 116 together provide a support for a rectangular jump board (not shown) that is vertically positioned with its bottom end engaged the channel formed by the jump board support 122. The back of the upper end of the jump board rests against the horizontal foot support portion of the foot bar 116. Alternatively, a jump board that has two spaced support posts may be used. In this alternative, the posts would fit into one pair of the holes 120.

Figure 2:
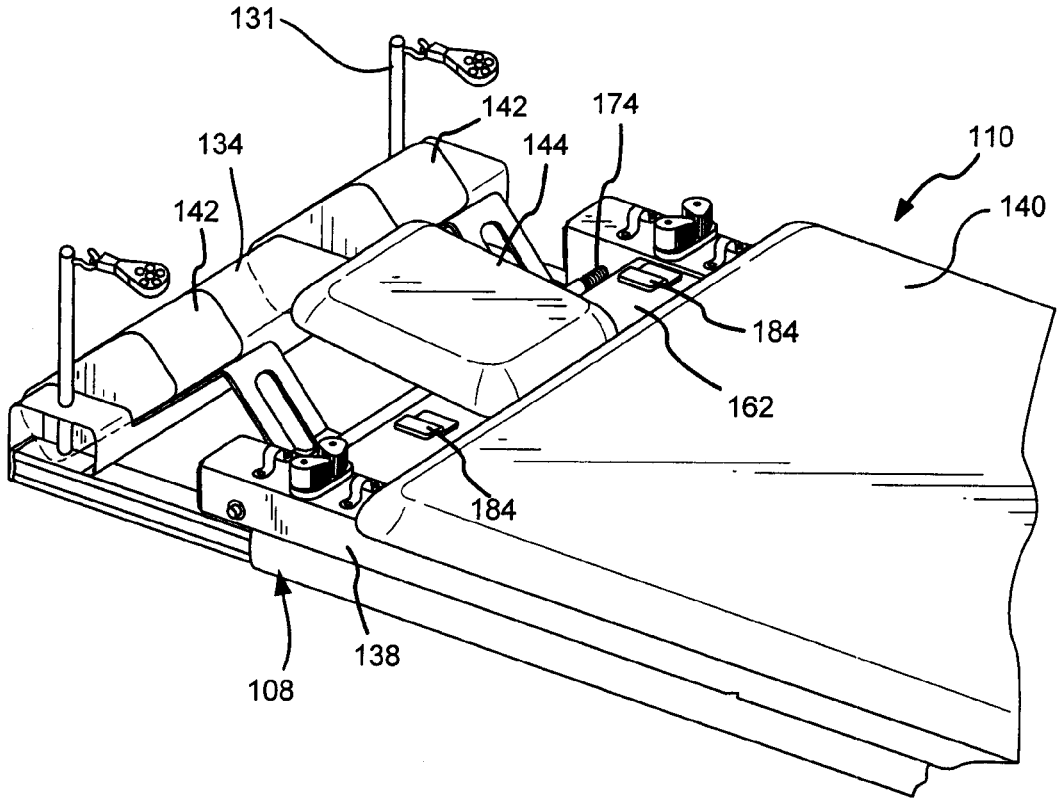
FIG. 2 is a partial perspective view of a reformer with the carriage shown in FIG. 1 having the shoulder stops in a folded, storage position.

The head end 104 is designed to space the telescopic rail member assemblies 108 rigidly apart, act as a handle when the reformer 100 is collapsed, receive upper ends of the shoulder stops, and support a pair of pulley assemblies 130 on removable posts 131 for hand cords (not shown). One end of the hand cord is adjustably fastened to cleats 126 on the carriage 110. A user typically grips the other end of the cord during arm or leg exercises. The head end 104 has a folded sheet metal cross member 132, preferably made of steel, aluminum or an aluminum alloy, that is fastened to the head ends of the rail member assemblies 108 by a spud that receives screws securing the cross member 132 to the head ends of the rails 108. The cross member 132 preferably has a vertical wall and a top wall 134. The ends of the rail member assemblies 108 are fastened to the vertical wall of the cross member 132, as shown in FIG. 5. The top wall 134 of the cross member 132 has a portion that slopes downward toward the top of the rail member assemblies 108. The top wall 134 of the cross member 132 is screwed or otherwise fastened to the top of the rail member assemblies 108 through the spud (not shown) located inside the head ends of the rail member assemblies 108. The top wall 134 has a pair of spaced cutouts 136 for receiving the shoulder stops 142 when the shoulder stops 142 are in a folded position as shown in FIG. 2 and further described below.

Referring back to FIGS. 1 and 2, the head end of the carriage assembly 110 is separately shown in two perspective views. The carriage assembly 110 has a rigid sheet metal frame 138 that has a folded, generally rectangular shape. A flat rectangular cushion pad 140 is secured to the upper surface of the frame 138. A pair of shoulder stops 142 are spaced apart and fastened to the frame 138 near a head end of the frame 138 in accordance with the present invention. These shoulder stops 142 engage a user's shoulders when the user lies on his or her back on the carriage 110 while exercising on the apparatus 100 and prevent the user from sliding toward the head end 104. A padded headrest 144 is fastened by a hinge at a base end of the headrest 144 to the frame 138 between the shoulder stops 142. A bracket 146 is pivotally fastened to the underside of the headrest 144. This bracket 146 is an oval structure with an elongated slot that has a set of notches 148 and can be rotated by a user to adjust the incline of the headrest 144 between one of three positions. The hinged bracket 146 rests upon a tubular support sleeve 150, which in turn slides on a common axle 152. The axle 152 preferably passes through the carriage frame channels 154 of the frame 138 and is fastened to the carriage frame 138 via snap rings.

Figure 7:
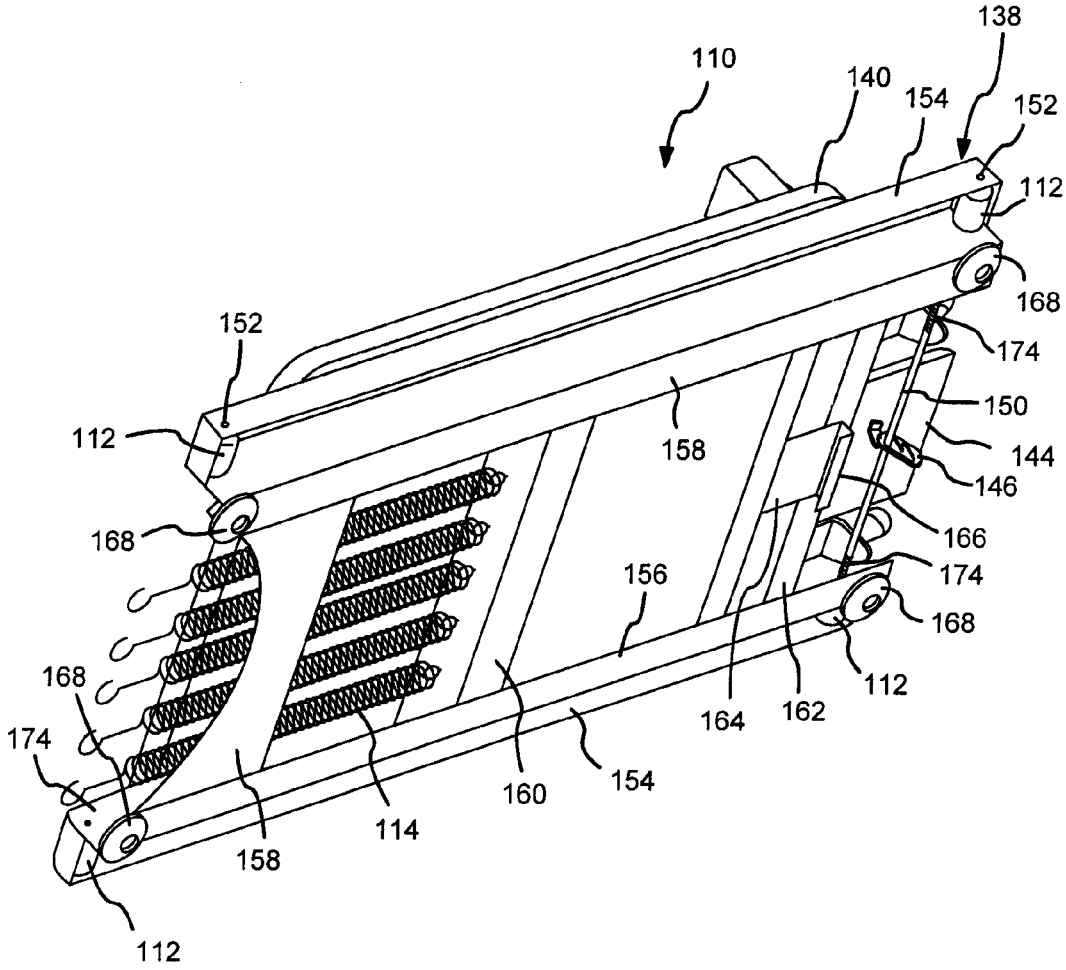
FIG. 7 is a separate perspective full view of the underside of the carriage in accordance with an embodiment of the present invention.

A separate perspective view of the underside of the carriage assembly 110 shown in FIG. 7 shows the structure of the carriage frame 138. The frame 138 may be formed from a single piece of sheet material or from sheet material sections that may be welded or otherwise fastened together. The frame 138 has two parallel U shaped side channels 154, each of which has a longitudinal flange 156. A series of three cross members 158,160 and 162 are rigidly fastened to the flanges 156. The head end cross member 162 is an elongated piece of sheet metal folded to a C shaped cross sectional shape. This cross member 162 has a latch portion 164 that extends to form a hook portion 166 to engage a flange on a track frame cross rail 109 (shown in FIG. 6) to capture the head end of the carriage 110 to the rail assemblies 108 when the carriage is fully retracted against the foot end 106.

The middle cross brace member 160 is preferably also a sheet material member, such as steel sheet metal, folded into a C shaped cross sectional shape that spans between the parallel side members 154 and is fastened to the flanges 156. This cross brace member supports the underside of deck pad 140 and acts as the carriage end anchor for the springs 114. The foot end cross member 158 has again a C shaped cross sectional shape, and has a series of holes (not shown) through a vertical portion of the cross brace member 160 through which springs 114 pass.

At each end of the flanges 156 on the side channel members 154 are rotatably mounted guide wheels 168. These guide wheels rotate about vertical axes and ride against the vertical walls of the track member assemblies 108 to keep the carriage 110 centered as it moves back and forth on the track assemblies 108.

At the head end of the frame 138 a single axle 152 passes through the channel portions 154 and through the head end rollers 112 located in both channel portions 154. At the foot end of the frame 138, each roller 112 has a short axle 172 that secures the roller 112 to its respective channel portion 154. The single axle 152 at the head end passes through the channel portions 154, the rollers 112, and through the support tube or sleeve 150. Thus the axle 152 also passes through the headrest support bracket 146 and preferably supports the rollers 112, the shoulder stops 142, and the headrest 144. Against each end of the support sleeve 150 on the axle 152 is a coil spring 174. Each spring 174 is sandwiched between the support sleeve 150 and the adjacent channel portion 154 so that the support sleeve 150 is spring biased in a centered position between the channel portions 154.

Figure 1:
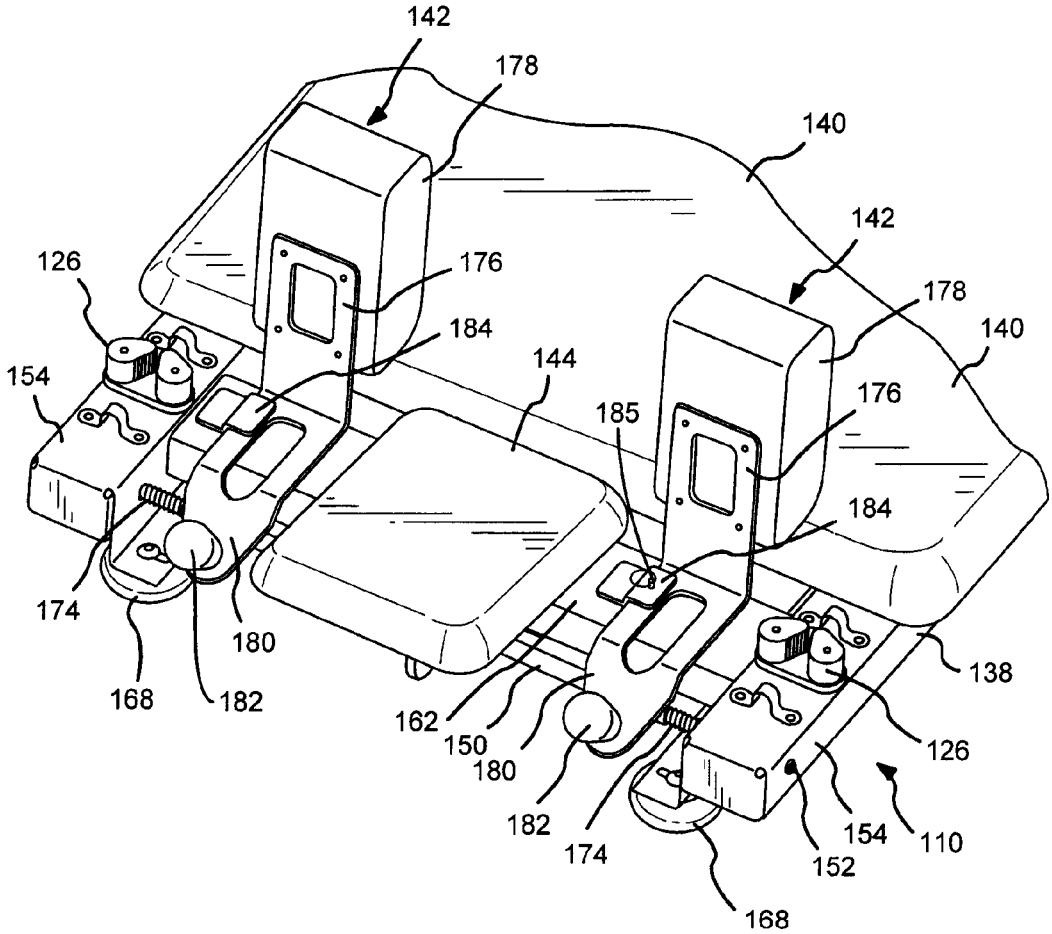
FIG. 1 is a partial upper perspective view of the head end of the carriage used in one embodiment of the reformer exercise apparatus in accordance with the present invention showing the shoulder stops in an upright and locked position.

Each of the shoulder stops 142 includes a generally L shaped support bracket 176 that has a cushion 178 mounted on one leg of the bracket and an angled flap 180 formed on the other leg. The flap 180 is rigidly fastened to the support sleeve 150 and has a knob handle 182 affixed to a distal end of the flap 180. The top of the carriage frame cross member 162 has a latch 184 fastened next to each L shaped support bracket 176 such that the latch 184 forms an open slot that receives the bracket flap 180 underneath it to latch the shoulder stops 148 in an upright normal support position, as is shown in FIGS. 1 and 5. The springs 174 at each end of the tubular sleeve 150 bias the support sleeve 150 such that the shoulder stop brackets 176 remain retained under the latches 184. In addition, a removable latch pin 185 passing through the latch 184, flap 180 and cross member 162 is preferably used to positively lock the shoulder stops 142 in normal position.

Figure 3:
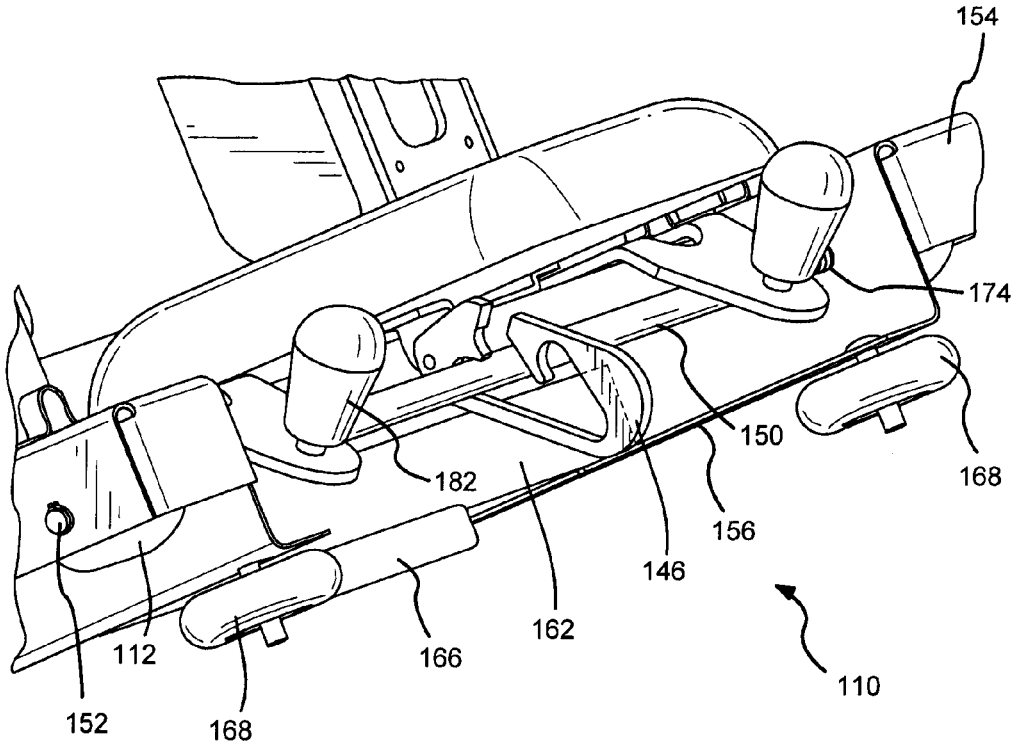
FIG. 3 is an enlarged partial perspective view of the head end of the carriage shown in FIG. 1 with the headrest lowered.
Figure 4:
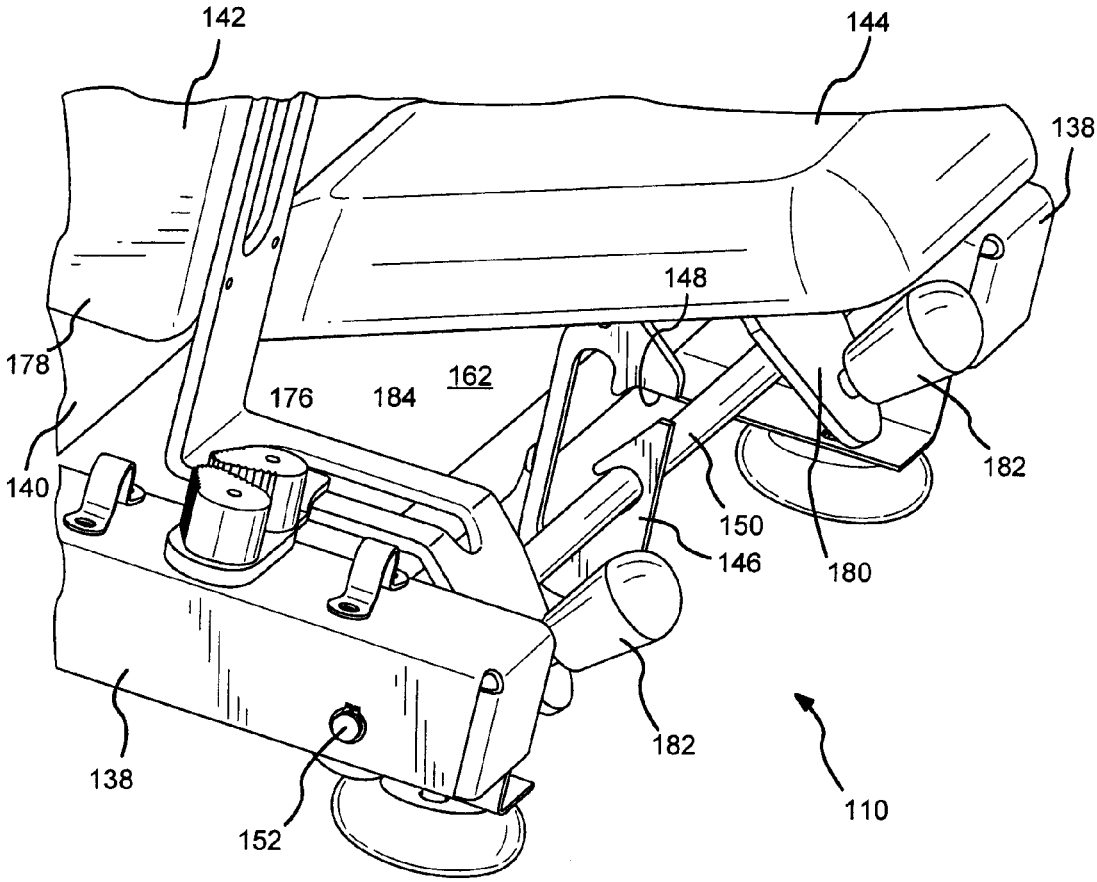
FIG. 4 is an enlarged perspective view of the carriage shown in FIG. 3 with the headrest raised.

When a user wants to store the reformer 100, she collapses the frame rail assemblies 108 to capture the carriage 110, removes the pin 185, moves the knob 182 to the right in FIG. 1 to slide the support sleeve 150 to the right, disengaging the brackets 176 from the latches 184, and then rotates the shoulder stops 142 to the storage position shown in FIG. 2. When the frame 102 is collapsed, the pads 178 of the shoulder stops 142 fit into the cutouts 136 in the cross member 132 of the head end 104. As is best shown in FIGS. 3 and 4, the axle 152 supports the head end of the channel members 154, the roller wheels 112, the shoulder stops 142 via the sleeve 150, and the headrest 144 via the bracket 146.

Many changes may be made to the carriage in accordance with the present invention that will be readily apparent. For example, the form and shape of the headrest and shoulder stops may be different than as shown in the drawing figures. The carriage frame 138 may be constructed from a single sheet of sheet metal folded to form the complete frame structure of elements 154, 156, 158, 160, 162 and 164. However, such a single piece structure may be more difficult to manufacture than one made of separate pieces, riveted, bolted or welded together.

The headrest support bracket 146 may be a different shape than that shown. It may, for example, be a closed oval or simply an elongated post member with laterally extending arms forming shelves to engage the tube 150 on the axle 152 to provide the several various elevational support positions. The axle 152 may be separate from the head end roller axles. In such an alternative, the axle 152 would pass into the channel members 154 at a location spaced from the rollers 112 and the rollers 112 would have separate axles. Accordingly, the invention may be practiced other than as specifically described and shown herein with reference to the illustrated embodiments. The present invention is not intended to be limited to the particular embodiments illustrated but is intended to cover all such alternatives, modifications, and equivalents as may be included by the following claims. All patents, patent applications, and printed publications referred to herein are hereby incorporated by reference in their entirety.

What is claimed is:

1. A reformer exercise apparatus comprising:

a generally rectangular frame having a head end, a foot end and a pair of spaced apart parallel track members therebetween;

a movable carriage mounted on the rectangular frame for movement along the track members between the head and foot ends;

the carriage having a carriage frame with a pair of spaced rollers mounted on a common single axle at a head end thereof, wherein each roller is positioned to roll on one of the tracks;

a pair of spaced shoulder stops fastened to the carriage;

a headrest fastened to the carriage frame between the shoulder stops, wherein the headrest is supported by the axle; and plurality of elongated elastic members extending between the carriage and the foot end of the rectangular frame for biasing the carriage toward the foot end of the frame.

2. The apparatus of claim 1 wherein the shoulder stops are rotatably mounted on the common axle.

3. The apparatus of claim 2 further comprising a tubular sleeve on the axle extending between the rollers wherein at least one of the shoulder stops is fastened to the tubular sleeve.

4. The apparatus of claim 1 wherein the headrest has a notched support member extending therefrom engaging the axle to provide a plurality of headrest support positions above the carriage frame.

5. The apparatus according to claim 1 wherein the carriage frame comprises a pair of parallel spaced channel members and the axle passes through each of the spaced channel members to support one of the head end roller wheels in each channel member.

6. A carriage assembly for use on a reformer exercise apparatus having a pair of parallel spaced tracks such that the carriage assembly may be moved back and forth on the tracks, the carriage assembly comprising:

a carriage frame with a pair of spaced rollers mounted to a common axle extending across the head end of the frame, wherein each roller is positioned to roll on one of the tracks; and a head rest at the head end of the frame at least partially supported by the common axle.

7. The carriage assembly according to claim 6 wherein the frame has a pair of spaced parallel channel members and the common axle extends through both channel members with one of the rollers in each channel.

8. The carriage assembly of claim 6 wherein the headrest has a notched support member extending therefrom supported by the axle providing a plurality of headrest support positions above the carriage frame.

9. A carriage for use in a reformer exercise apparatus having a pair of parallel spaced tracks for supporting the carriage for movement back and forth on the tracks, the carriage comprising:

a generally rectangular carriage frame having a pair of parallel channel members spaced to operably ride on the tracks, the carriage frame having a pair of rollers at a head end thereof mounted on a common axle passing through the channel members and supporting the head end of the frame; and a head rest mounted on the carriage frame, wherein the head rest is partially supported by the common axle.

10. The carriage of claim 9 wherein the headrest has a notched support member extending therefrom engaging the axle to provide a plurality of headrest support positions above the carriage frame.

* * * * *